US011178977B1

(12) United States Patent
Legbeti et al.

(10) Patent No.: US 11,178,977 B1
(45) Date of Patent: Nov. 23, 2021

(54) GLIDER FURNITURE SAFETY SKIRT

(71) Applicant: Glider Skirt, Inc., Wilmington, NC (US)

(72) Inventors: Emmanuel Legbeti, Wilmington, NC (US); Amanda M Legbeti, Wilmington, NC (US)

(73) Assignee: Glider Skirt, Inc., Wilmington, NC (US)

( * ) Notice: Subject to any disclaimer, the term of this patent is extended or adjusted under 35 U.S.C. 154(b) by 0 days.

(21) Appl. No.: 16/363,594

(22) Filed: Mar. 25, 2019

Related U.S. Application Data

(60) Provisional application No. 62/648,457, filed on Mar. 27, 2018.

(51) Int. Cl.

| | |
|---|---|
| ***A47C 31/00*** | (2006.01) |
| ***A47C 31/11*** | (2006.01) |
| ***A47C 7/62*** | (2006.01) |
| *A47C 3/025* | (2006.01) |

(52) U.S. Cl.
CPC ..... *A47C 31/11* (2013.01); *A47C 7/62* (2013.01); *A47C 3/0255* (2013.01)

(58) Field of Classification Search
CPC ..... A47C 17/86; A47C 21/00; A47C 21/04; A47C 21/044; A47C 21/048; A47C 31/008; A47C 7/72; A47C 11/005; A47C 15/00; A47C 16/00; A47C 16/02; A47C 17/136; A47C 17/1753; A47C 17/1756; A47C 1/03211; A47C 1/03294; A47C 1/12; A47C 1/124; A47C 21/022; A47C 27/0453; A47C 27/053; A47C 27/056; A47C 27/068; A47C 27/07; A47C 27/08; A47C 27/086; A47C 27/14; A47C 27/15; A47C 31/00; A47C 31/105; A47C 31/113; A47C 31/12; A47C 3/04; A47C 4/286; A47C 4/30; A47C 4/32; A47C 4/38; A47C 4/42; A47C 4/48; A47C 5/06; A47C 7/00; A47C 7/185; A47C 7/383; A47C 7/44; A47C 7/5062; A47C 7/5068; A47C 7/622; A47C 7/626; A47C 7/66
See application file for complete search history.

(56) References Cited

U.S. PATENT DOCUMENTS

| | | | | |
|---|---|---|---|---|
| 2,818,106 | A * | 12/1957 | Reavis | A47C 31/11 297/227 |
| 3,195,950 | A * | 7/1965 | Mednick | A47C 31/11 297/227 |
| 3,687,449 | A | 8/1972 | Newman | |

(Continued)

*Primary Examiner* — Shin H Kim
(74) *Attorney, Agent, or Firm* — NK Patent Law

(57) ABSTRACT

A furniture skirt to attach beneath the seat surface of a glider furniture piece which carries safety barriers positioned to hinder access to area between moving and stationary parts of the glider furniture piece which may present a pinching safety hazard when the moving parts are in motion. The furniture skirt has side sections sized and shaped to hang adjacent side surfaces of the glider furniture piece which are oriented parallel with the gliding motion of the furniture piece. Inflexible plates are carried by the side sections of the skirt to obstruct insertion of objects, such as fingers, within the area between moving and stationary parts of the furniture to prevent injury.

8 Claims, 5 Drawing Sheets

(56) References Cited

U.S. PATENT DOCUMENTS 4,153,097 A * 5/1979 Pettibone ..... A47G 21/167 160/330
4,365,371 A * 12/1982 Boussaroque ..... A47C 27/16 5/728
4,616,873 A 10/1986 Debo
4,930,274 A * 6/1990 Cummings ..... E04D 13/031 52/200
5,344,214 A 9/1994 Trent
5,540,480 A * 7/1996 Christa ..... A47C 31/11 297/219.1
5,544,393 A * 8/1996 Lightfoot ..... A47H 13/04 160/330
5,621,931 A * 4/1997 Hamilton ..... A47G 9/0292 5/493
5,733,397 A 3/1998 McDaniel
5,943,698 A * 8/1999 Blanks ..... G09F 21/02 2/115
6,073,283 A * 6/2000 Zheng ..... A47G 9/062 5/417
6,276,009 B1 * 8/2001 Schrougham ..... A47G 9/0292 5/493
6,464,295 B1 10/2002 Bergeron et al.
6,485,100 B1 * 11/2002 Hitt ..... A47C 7/18 297/219.1
6,598,249 B2 * 7/2003 Pajanacci ..... A47C 19/02 5/482
6,687,931 B1 * 2/2004 Benavides ..... A01K 1/0353 5/485
6,775,858 B1 8/2004 Miller
7,281,281 B2 * 10/2007 Langenberger ..... A47G 9/0284 5/486
7,621,006 B1 * 11/2009 Tucker ..... A47G 9/0292 108/90
7,845,030 B1 * 12/2010 Pollard ..... A47C 19/124 5/2.1
7,984,522 B1 * 7/2011 Pfleger ..... A47G 9/0292 5/486
8,079,447 B2 12/2011 Zuercher
8,127,379 B2 * 3/2012 Hardee ..... A44B 18/0046 160/368.1
8,176,862 B2 * 5/2012 Birdwell ..... A47G 11/004 108/90
8,590,968 B2 11/2013 Zahir
8,671,477 B1 * 3/2014 Joyner ..... A47G 9/0292 5/493
8,973,184 B2 * 3/2015 Edgren ..... A47G 9/0292 160/123
9,376,161 B2 6/2016 Stillwell et al.
2004/0221393 A1 * 11/2004 Stokes ..... A47C 21/028 5/692
2006/0075556 A1 * 4/2006 Wootten ..... A47G 9/0246 5/485
2007/0074346 A1 * 4/2007 Wallace ..... A61F 13/10 5/600
2010/0132595 A1 * 6/2010 Gledhill ..... A47G 11/003 108/90
2012/0297541 A1 * 11/2012 Brown ..... A47G 9/02 5/490
2014/0070575 A1 * 3/2014 von Saher ..... A47C 7/62 297/188.2
2015/0013067 A1 * 1/2015 Coughlin ..... A47G 9/0292 5/493
2015/0020310 A1 * 1/2015 Guillaume ..... A47G 9/062 5/417
2015/0040316 A1 * 2/2015 Graves ..... A47G 9/0292 5/493
2015/0084307 A1 3/2015 Goldish et al.
2016/0120324 A1 * 5/2016 D'Amato ..... A47B 97/00 150/158
2017/0295939 A1 * 10/2017 King ..... A47C 7/54

* cited by examiner

GLIDER FURNITURE SAFETY SKIRT

CROSS-REFERENCE TO RELATED APPLICATION

This application claims the benefit of U.S. Provisional Patent Application No. 62/648,457 filed Mar. 27, 2018 which application is hereby incorporated by reference.

BACKGROUND

Field of the Invention

This invention relates generally to the field of furniture skirts, and more particularly to skirts for glider-type furniture such as glider rocking chairs.

Background Art

Traditional glider-type furniture designs generally comprise a stationary frame with a pivotally-mounted seating surface that glides back-and-forth over the frame. The most common kinds of glider-type furniture include glider chairs, footrests (ottomans or footstools) and benches, to name a few. FIG. 1 shows a traditional glider rocking chair design that is generally made up of stationary frame 10 with pivotally-mounted chair 12.

Gliding, back-and-forth motion of the glider furniture seat with respect to its stationary frame creates pinch point areas between the two where fingers, toes and similar small items may be caught therebetween if the areas are left exposed. FIG. 2 is an enlarged view of the lower portions of the chair of FIG. 1 which indicates two pinch point areas (14) of the several created between the stationary parts (16) of frame 10 and the moving parts (18) of chair 12 when chair 12 is put into back-and-forth motion as illustrated by the arrows (18*a*) in the figure. A substantial amount of shearing force can be generated by the moving parts (18) of chair 12 moving past the stationary parts (16) of frame 10 when an adult is seated in the chair and imparts a rocking motion to the chair.

This safety issue has been acknowledged and has resulted in design improvements in the past. For example, many glider rocking chair designs now include a brake which prevents the chair from moving when it is engaged. Another design improvement is disclosed in U.S. Pat. No. 5,344,214 to Trent (hereby expressly incorporated by reference) which describes the safety issue and shows an alternative glider chair design that reduces the potential for injury by incorporating enclosed side panels. (See FIG. 5 of the '214 Patent and its accompanying written description starting at Column 5, Line 61.) However, most glider rocking chairs in use today are designed as shown in FIG. 1 with an open, rail-and-spindle design that rely solely upon the brake to improve safety of operation. None the less, people have been seriously injured by inadvertently placing their fingers in the pinch point areas while the brake is disengaged resulting in badly mutilated and/or severed fingers.

An object of the present invention is to provide a furniture skirt with a safety barrier which may be used to retrofit glider furniture to make it safer to use.

SUMMARY OF THE INVENTION

The invention involves furniture skirts to attach beneath the seat surface of a glider piece of furniture which carry safety barriers positioned to hinder access to area between moving and stationary parts of the glider furniture piece. The furniture skirt is pliable, with side sections sized and shaped to hang adjacent side surfaces of the glider furniture piece which are oriented parallel with the gliding motion of the piece. The side sections of the furniture skirt carry inflexible plates which obstruct insertion of objects within the area between the moving and stationary part of the glider furniture piece.

BRIEF DESCRIPTION OF THE DRAWINGS

The features of the invention will now be described with reference to the drawings of a preferred embodiment, which are intended to illustrate and not limit the invention.

DETAILED DESCRIPTION OF A PREFERRED EMBODIMENT

A detailed description of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 8:
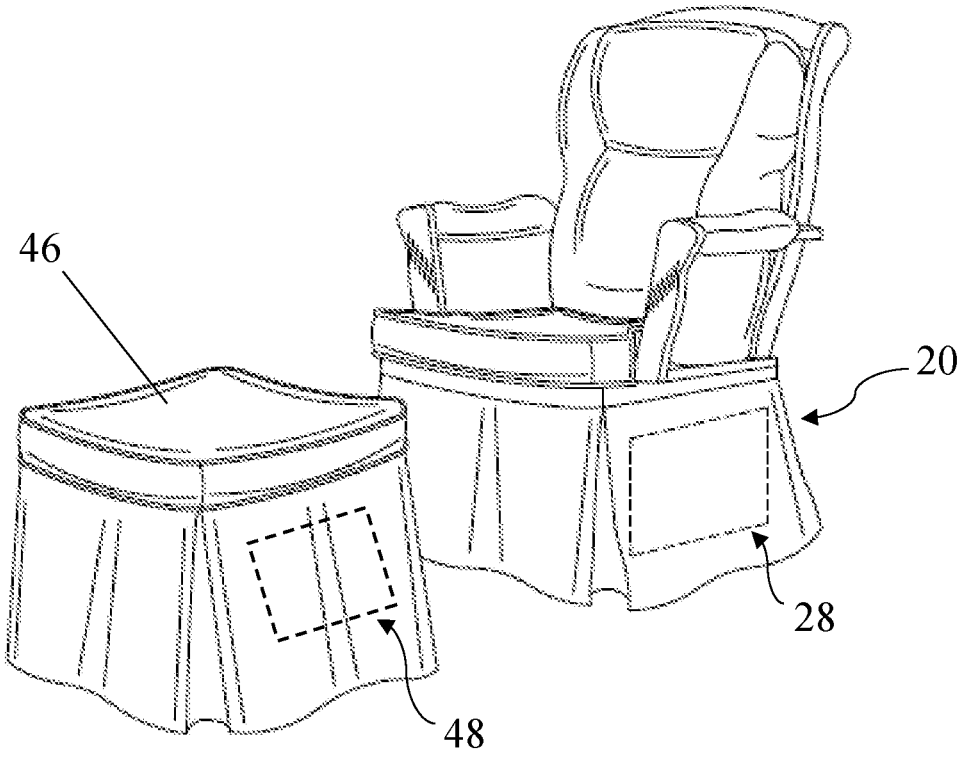
FIG. 8 shows the appearance of the skirt of FIG. 4 and FIG. 5 after it is installed on a glider chair and footrest pair.

The present invention generally involves furniture skirts for retrofit installation around the seating surface of glider-type furniture which carry safety barriers to be positioned adjacent the furniture's pinch point areas to prevent (block) accidental insertion of fingers (appendages) in the areas. While this written description will describe in detail how to make and use a glider furniture safety skirt designed specifically for a glider rocking chair, it should be understood by those skilled in the art that the skirt's design can be configured for use with other types of glider furniture, such as glider ottomans, glider footrests (footstools) and glider benches. For example, glider chairs are commonly sold as a set with a matching glider ottoman which allows a person seated in the glider chair to put their feet up on the glider ottoman without slowing the gliding motion of the chair. It is therefore contemplated a glider chair and ottoman safety skirt pair can be sold together in a unit as an accessory for a glider chair and ottoman set, as shown in FIG. 8.

Figure 1:
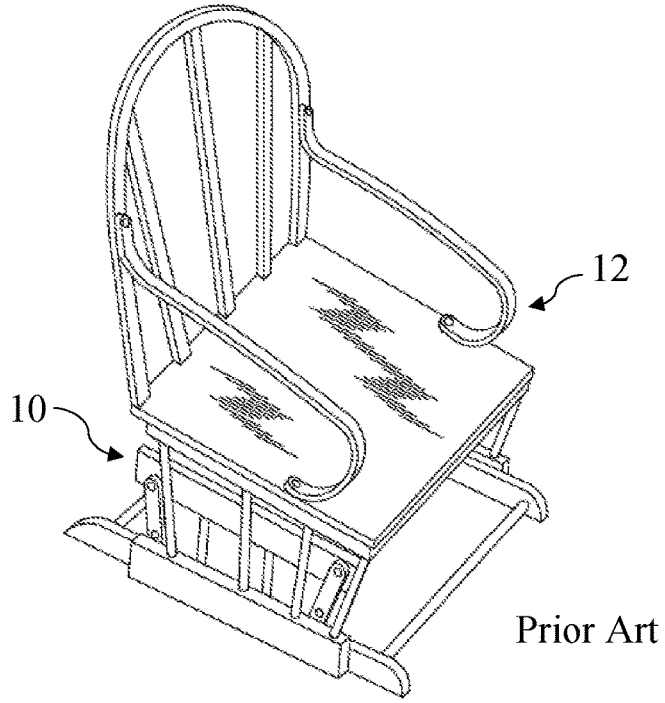
FIG. 1 is a perspective view of a typical, prior art glider rocking chair.
Figure 2:
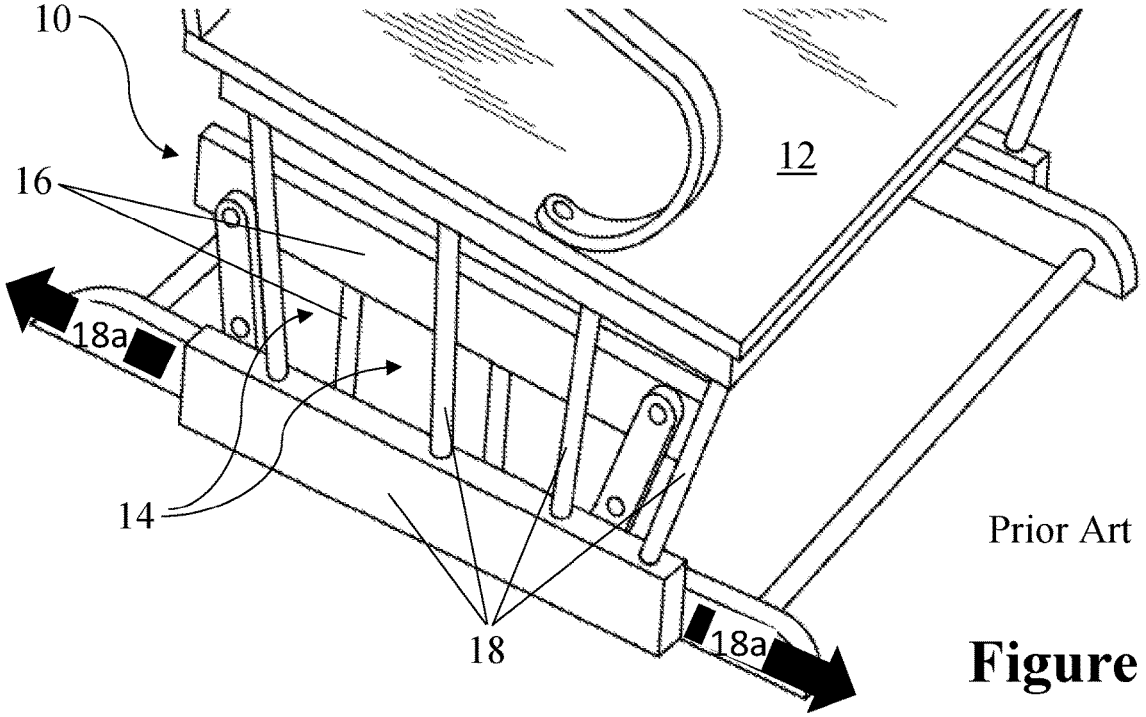
FIG. 2 is an enlarged view of the lower portions of the chair of FIG. 1.
Figure 3:
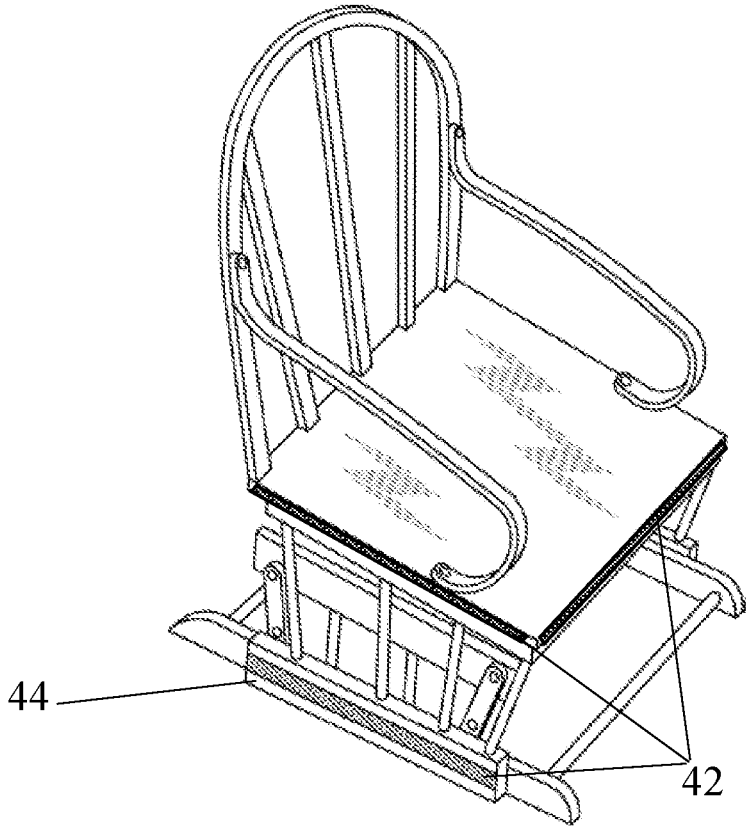
FIG. 3 shows the chair of FIG. 1 with a loop-type fastener applied.
Figure 4:
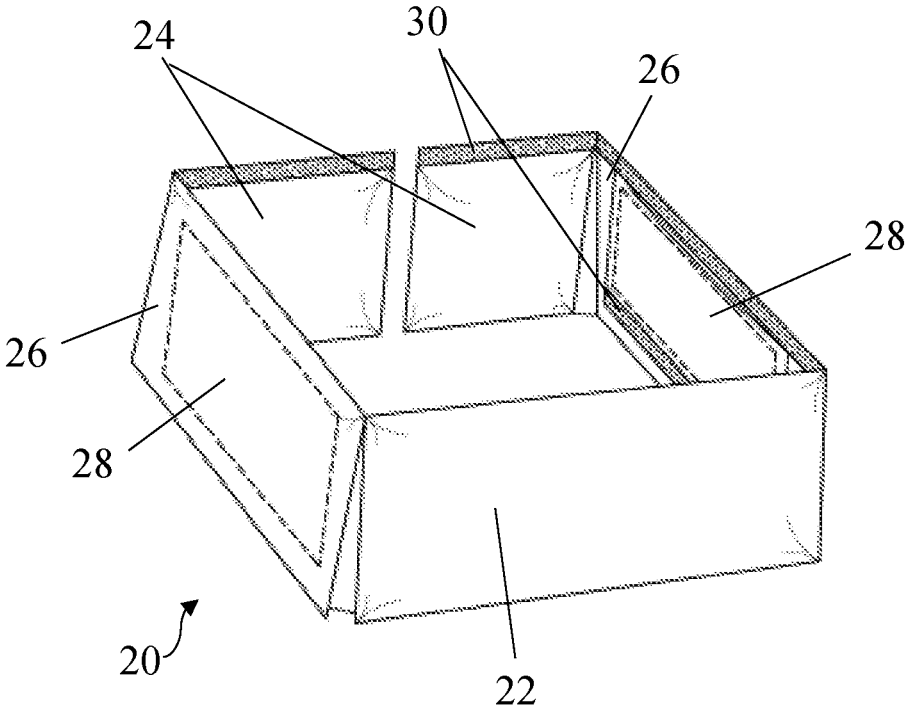
FIG. 4 is a perspective view of a preferred embodiment of a glider rocking chair safety skirt according to the invention.
Figure 7:
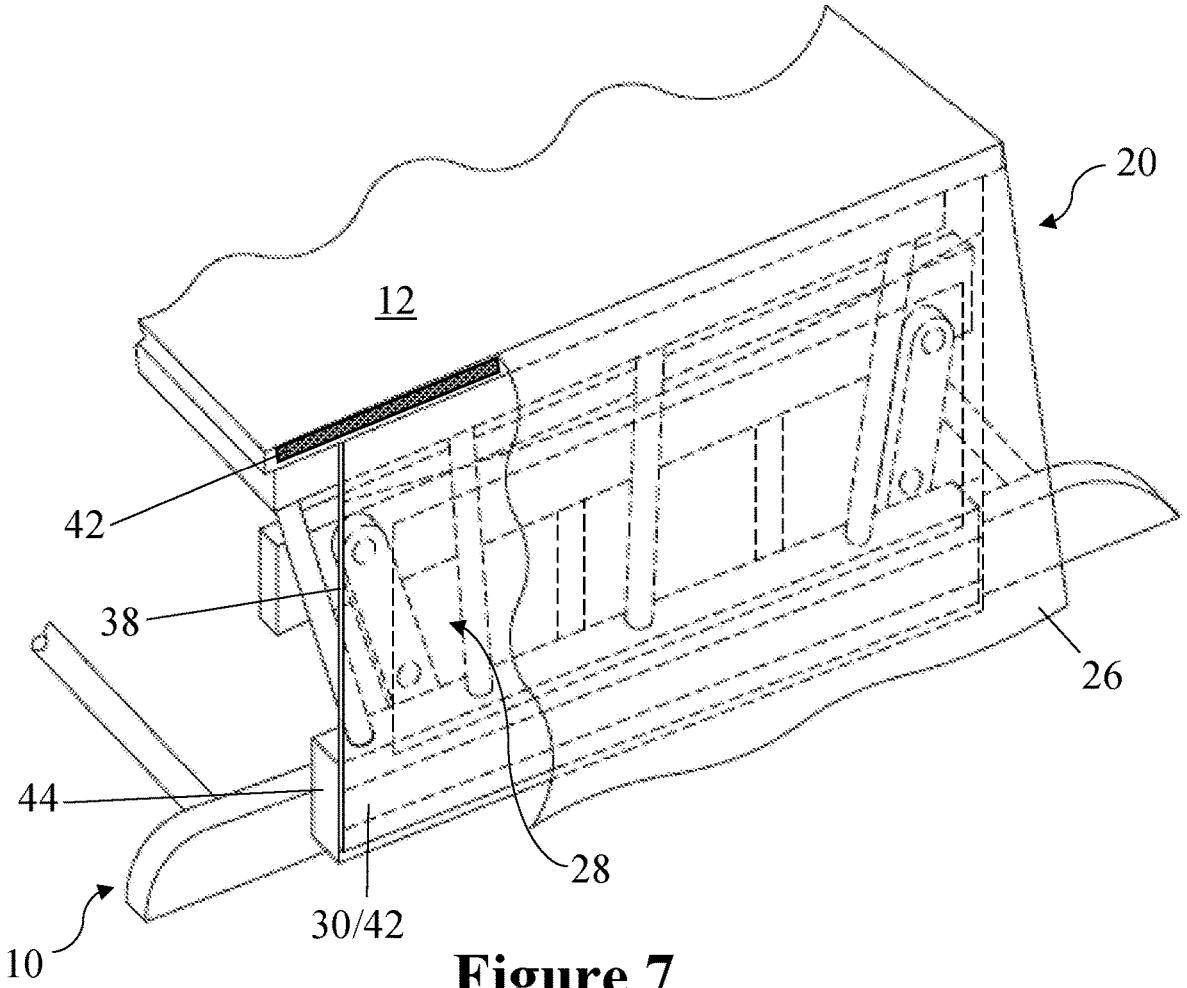
FIG. 7 shows detail of the skirt of FIG. 4 and FIG. 5 installed on a chair like the one in FIG. 1.

FIG. 4 shows a preferred embodiment of a glider rocking chair safety skirt 20 according to the invention which may be installed on a glider rocking chair like the one shown in FIGS. 1-3 as shown in FIG. 3 and FIG. 7. Skirt 20 generally comprises front panel section 22, back panel sections 24, side panel sections 26 carrying safety barriers 28, and fasteners 30. The skirt is preferably generally made of fabric which is aesthetically pleasing in its intended application and functional in its use. A handful of large manufactures sell the majority of glider chairs which use a small number of generally neutral in color, easily cleanable fabrics to upholster the chair's seat cushion to appeal to the largest number of purchasers possible. Safety skirts according to the invention and made for use with these glider chairs can be made of fabric which matches the glider chair's seat cushion, for example.

Figure 5:
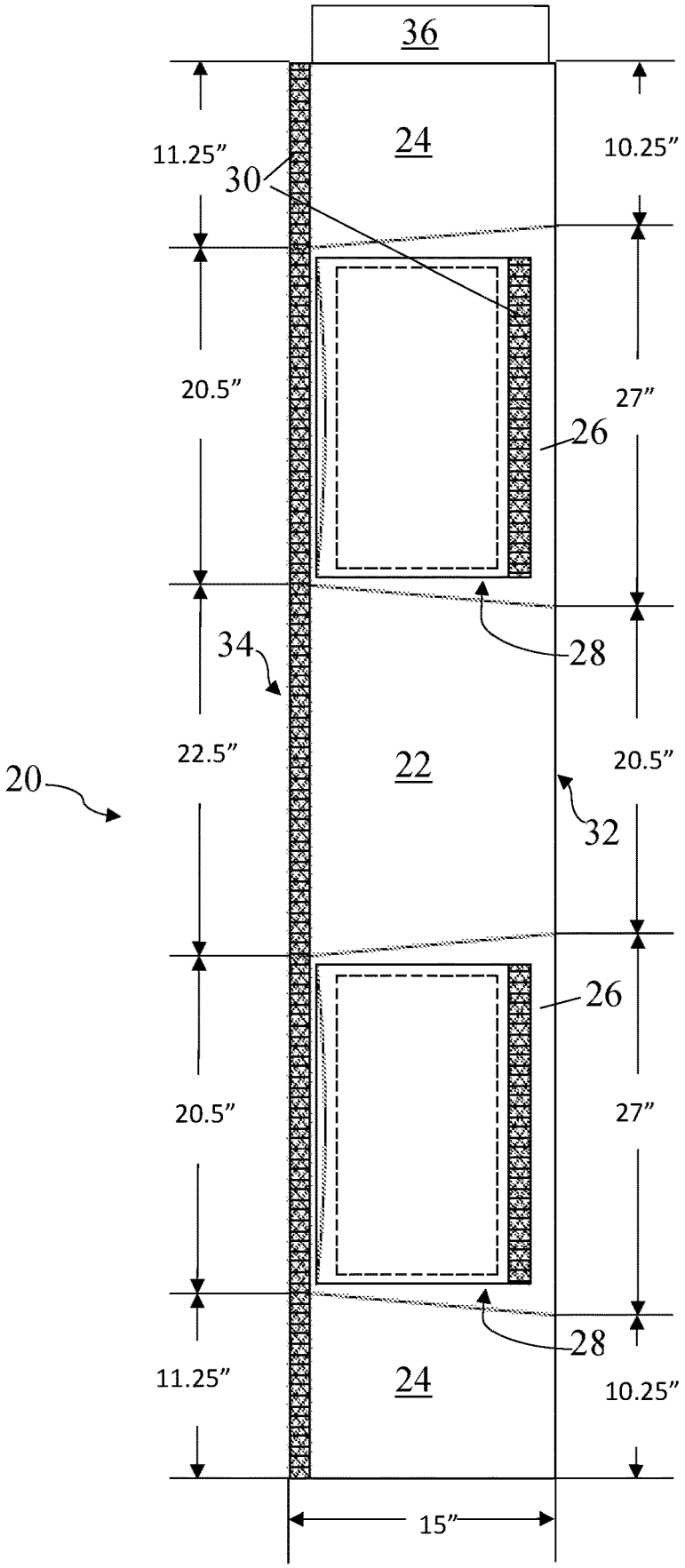
FIG. 5 show the skirt of FIG. 4 as it appears laid out flat, prior to installation on a chair.

FIG. 5 shows skirt 20 laid out flat to disclose the details of its configuration with approximate dimensions for a skirt made in a box-pleat style design where the lower edge (32) of the skirt flares out slightly from its upper edge (34). A back-closure flap (36) (not shown in FIG. 4) may optionally be used in the skirt design.

Figure 6:
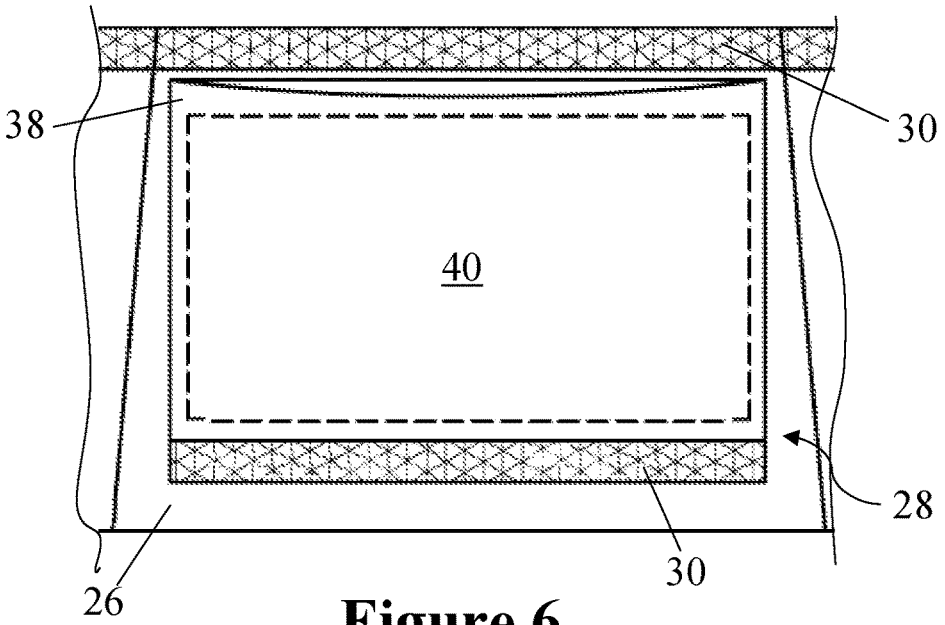
FIG. 6 is an enlarged view of the side panels of the skirt of FIG. 4 and FIG. 5.

The safety barriers used in the safety skirt of the invention can be made in different ways, with all of them having the common attribute of providing a semi-rigid to rigid (inflexible) surface that, when positioned adjacent glider furniture pinch point areas, prevents insertion of fingers and/or other appendages into the pinch point areas. FIG. 6 shows an enlarged view of safety barriers 28 shown in FIG. 4 and FIG. 5, which is a preferred embodiment that entails sewing a pocket (38) on the inside face of side panels 26 of skirt 20. A thin, semi-flexible sheet (or plate) of plastic (40) or other similar material can be inserted inside pocket 38, along with, optionally, interfacing or interlining type material which is used to reduce sound created by movement of sheet 40 within pocket 38 while the glider chair is in motion. A more simplified, but perhaps less desirable embodiment of the safety barrier generally involves gluing or otherwise affixing sheet 40 directly to the inside face of the side panels without the added time and expense involved in making pocket 38.

Skirt 20 is installed on chair 12 as shown in FIG. 3 and FIG. 7. First, strips (42) of one part of a hook-and-loop fastener pair (commonly sold under the registered trademark VELCRO®) are adhered around the edges of the chair's seating surface and along the lower rails (44) as shown in FIG. 3. Skirt 20 is then situated and positioned around the chair's seating surface and adjacent strips 42 so that fasteners 30 (the mating part of the hook-and-loop fastener pair) may be secured to strips 42 as shown in FIG. 7. Securing the bottom edge of pocket 38 to rails 44 helps to hold the safety barriers in place and reduces their movement while the glider chair is in motion.

FIG. 8 shows safety skirts made according to the invention may be configured to fit other types of glider furniture, such as ottomans like the one shown (46). In these other configurations, the safety barrier (48) can be sized and shaped to conform to the relative size and shape of the pinch point areas created by the piece of glider furniture.

While the invention has been described in connection with a preferred embodiment, it is not intended to limit the scope of invention to the particular form(s) set forth, but on the contrary, it is intended to cover such alternatives, modifications, and equivalents as may be included within the spirit and scope of the invention.

What is claimed is:

1. A protective skirt assembly for a gliding chair, the skirt assembly comprising:

an ornamental main skirt engaging with a primary fastener section on an upper portion of an inner facing surface of the protective skirt assembly, the primary fastener section being configured for selective engagement with a first perimeter portion of the chair;

a protective skirt carried by the ornamental main skirt and configured for being positioned between the ornamental main skirt and the chair;

wherein the protective skirt further defines a secondary fastener section on a lower portion of an inner facing surface of the protective skirt, wherein the secondary fastener section is configured for selective engagement with a second perimeter portion of the chair, wherein the second perimeter portion of the chair is on a lower glider bar of the chair, wherein the second perimeter portion of the chair maintains a same position relative to the first perimeter portion of the chair when the chair is in a gliding operation, wherein the primary fastener section and the secondary fastener section secure the protective skirt to the first perimeter portion and the second perimeter portion.

2. The skirt assembly of claim 1, wherein a bottom portion of the ornamental main skirt is unattached.

3. The skirt assembly of claim 1, wherein the primary fastener section is a hook and loop fastener.

4. The skirt assembly of claim 1, wherein the protective skirt is a fabric.

5. The skirt assembly of claim 1, wherein the secondary fastener section is a hook and loop fastener.

6. The skirt assembly of claim 1, wherein selective engagement of the primary fastener section and the secondary fastener section pulls the protective skirt into a taut arrangement about the first perimeter portion and the second perimeter portion of the chair.

7. The skirt assembly of claim 1, wherein the first perimeter portion is vertically spaced-apart from the second perimeter portion.

8. The skirt assembly of claim 1, wherein the protective skirt is not attached to the ornamental main skirt at respective bottom portions of each of the protective skirt and the ornamental main skirt, thereby allowing relative movement of the respective bottom portions.

* * * * *